US008671700B2

(12) United States Patent
Duong et al.

(10) Patent No.: US 8,671,700 B2
(45) Date of Patent: Mar. 18, 2014

(54) HIGH PRESSURE CRYOGENIC FLUID GENERATOR

(75) Inventors: Thach Duong, Tustin, CA (US); Jay J. Eum, Irvine, CA (US)

(73) Assignee: Endocare, Inc., Austin, TX (US)

( * ) Notice: Subject to any disclaimer, the term of this patent is extended or adjusted under 35 U.S.C. 154(b) by 1094 days.

(21) Appl. No.: 12/690,866

(22) Filed: Jan. 20, 2010

(65) Prior Publication Data

US 2010/0180607 A1 Jul. 22, 2010

Related U.S. Application Data

(60) Provisional application No. 61/146,277, filed on Jan. 21, 2009.

(51) Int. Cl.
*F04B 53/12* (2006.01)
*F04B 15/08* (2006.01)

(52) U.S. Cl.
USPC ..... 62/50.6; 417/547; 417/901

(58) Field of Classification Search
USPC ..... 62/50.6; 417/523, 529, 547, 552, 555.1, 417/556, 901
See application file for complete search history.

(56) References Cited

U.S. PATENT DOCUMENTS

| | | | | |
|---|---|---|---|---|
| 3,632,235 | A | 1/1972 | Grenci | |
| 4,345,598 | A | 8/1982 | Zobac | |
| 4,472,946 | A | 9/1984 | Zwick | |
| 4,792,289 | A | 12/1988 | Nieratschker | |
| 4,860,545 | A | 8/1989 | Zwick | |
| 4,915,602 | A | 4/1990 | Tschopp | |
| 4,946,460 | A | 8/1990 | Merry | |
| 5,254,116 | A | 10/1993 | Baust | |
| 5,257,977 | A | 11/1993 | Eshel | |
| 5,334,181 | A | 8/1994 | Rubinsky | |
| 5,400,602 | A | 3/1995 | Chang | |
| 5,573,532 | A | 11/1996 | Chang | |
| 5,916,212 | A | 6/1999 | Baust | |
| 6,102,676 | A * | 8/2000 | DiCarlo et al. | 417/460 |
| 6,530,761 | B1 * | 3/2003 | Chalk et al. | 417/552 |
| 7,083,612 | B2 | 8/2006 | Littrup | |
| 7,192,426 | B2 | 3/2007 | Baust | |

(Continued)

OTHER PUBLICATIONS

International Application No. PCT/US2010/041794 International Search Report and Written Opinion of the International Searching Authority Dated Sep. 2, 2010 Relative to International Publication No. WO 2011/090504 Dated Jul. 28, 2011 (14 Pages).

(Continued)

*Primary Examiner* — John Pettitt
(74) *Attorney, Agent, or Firm* — Lawrence N. Ginsberg

(57) ABSTRACT

The cryogenic fluid generator includes at least one pump assembly having an actuator mounted to a container assembly. A pump assembly housing includes a longitudinal positioning opening and a pressurization cavity at a distal end terminating with a pump assembly outlet. An internal check valve assembly includes a shaft positioned within an opening of the pump assembly housing that extends into the pressurization cavity. The shaft is attached to the actuator and includes a longitudinal guidance slot; a fluid passageway; and, an internal sealing surface. A positioning bar assembly is positioned within the guidance slot. A connecting rod is securely connected at a first end to the positioning bar assembly, the connecting rod being positioned within the fluid passageway and terminating with a flow inhibiting element. A seal is positioned between the pump assembly housing and the check valve to provide a closure for the pressurization cavity.

16 Claims, 9 Drawing Sheets

(56) References Cited

U.S. PATENT DOCUMENTS

| | | | |
|---|---|---|---|
| 7,273,479 | B2 | 9/2007 | Littrup |
| 7,410,484 | B2 | 8/2008 | Littrup |
| 7,416,548 | B2 | 8/2008 | Baust |
| 7,507,233 | B2 | 3/2009 | Littrup |
| 2002/0085921 | A1 * | 7/2002 | Gram et al. ..... 417/53 |

OTHER PUBLICATIONS

Two Web pages from Barber Nichols website which reflects the Long Shaft Cryogenic Pump. http://www.barber-nichols.com/products/cryogenic_products/long_shaft_cryogenic_pumps/default.asp.

* cited by examiner

HIGH PRESSURE CRYOGENIC FLUID GENERATOR

CROSS REFERENCE TO RELATED APPLICATIONS

This application claims the benefit of U.S. Provisional Application Ser. No. 61/146,277, filed Jan. 21, 2009, the entire contents of which are hereby incorporated herein by reference thereto.

BACKGROUND OF THE INVENTION

1. Field of the Invention

The present invention relates to cryogenic pumps and more particularly to a high pressure cryogenic fluid generator for use in cryosurgical procedures.

2. Description of the Related Art

The distribution of boiling (liquid) cryogens, such as liquid nitrogen, is problematic due to the parasitic heat load provided by a cryosurgical device's plumbing or transport circuit, which is maintained at ambient temperature. Pre-cooling the plumbing circuit, even if adequately insulated, causes two-phase flow (liquid-gas mixtures), cryogen boil-off, and choking flow due to gas expansion in the transport circuit. As a result, target temperatures at the distal end of the flow path (i.e., cryoprobe tip) are not reached for many minutes.

Some prior cryogenic systems and devices are disclosed in U.S. Pat. No. 4,345,598 to Zobac et al.; U.S. Pat. No. 4,472,946 to Zwick; U.S. Pat. No. 4,860,545 to Zwick et al.; U.S. Pat. No. 4,946,460 to Merry et al.; U.S. Pat. No. 5,254,116 to Baust et al.; U.S. Pat. No. 5,257,977 to Eshel; U.S. Pat. No. 5,334,181 to Rubinsky et al.; U.S. Pat. No. 5,400,602 to Chang et al.; U.S. Pat. No. 5,573,532 to Chang et al.; and U.S. Pat. No. 5,916,212 to Baust et al., the entire contents of each being hereby incorporated herein by reference thereto, respectively.

U.S. Pat. Nos. 7,416,548 and 7,192,426, both issued to Baust et al., and both entitled "Cryogenic System," disclose a cryogenic system with a pump assembly using a bellows that is submersible in cryogen which provides pressure to a cryoprobe greater than 250 psi. These patents are incorporated herein by reference, in their entireties, for all purposes.

Barber-Nichols, Inc. (BNI), Arvada, Colo., manufactures a Long Shaft Cryogenic Pump that uses a long, thin-walled shaft to separate the impeller (cold end) from the motor (warm end). This shaft minimizes heat leaking from the motor and atmosphere into the cryogenic fluid. However, the Barber-Nichols pump is rather bulky and cannot generate pressures in ranges required by the present applicant, i.e. greater than 250 psi.

Near critical cryogenic fluid generators are disclosed in, for example, U.S. patent application Ser. No. 10/757,768 which issued as U.S. Pat. No. 7,410,484, on Aug. 12, 2008 entitled "CRYOTHERAPY PROBE", filed Jan. 14, 2004 by Peter J. Littrup et al.; U.S. patent application Ser. No. 10/757,769 which issued as U.S. Pat. No. 7,083,612 on Aug. 1, 2006, entitled "CRYOTHERAPY SYSTEM", filed Jan. 14, 2004 by Peter J. Littrup et al.; U.S. patent application Ser. No. 10/952,531 which issued as U.S. Pat. No. 7,273,479 on Sep. 25, 2007 entitled "METHODS AND SYSTEMS FOR CRYOGENIC COOLING" filed Sep. 27, 2004 by Peter J. Littrup et al.; U.S. patent application Ser. No. 11/447,356 which issued as U.S. Pat. No. 7,507,233 on Mar. 24, 2009 entitled "CRYOTHERAPY SYSTEM", filed Aug. 6, 2006 by Peter J. Littrup et al.; U.S. Pat. Nos. 7,410,484, 7,083,612, 7,273,479 and 7,507,233 are incorporated herein by reference, in their entireties, for all purposes.

SUMMARY OF THE INVENTION

In a broad aspect, the present invention is a high pressure cryogenic fluid generator that includes a container assembly for containing a cryogenic fluid; at least one pump assembly; and, at least one external check valve. The at least one pump assembly includes an actuator mounted to the container assembly. A pump assembly housing of the pump assembly has a housing opening and is securely attached at a first end thereof to the container assembly. The pump assembly housing includes at least one longitudinal positioning opening. The pump assembly housing has a pressurization cavity formed therein at a distal end terminating with a pump assembly outlet. An internal check valve assembly is operatively associated with the pump assembly housing. The internal check valve assembly includes a shaft positioned within the housing opening of the pump assembly housing and having a distal end thereof. The shaft extends into the pressurization cavity, the shaft being fixedly attached at a first end to the actuator and including a longitudinal guidance slot. The shaft has a fluid passageway formed therein that extends from the longitudinal guidance slot to the distal end. The distal end of the shaft has an internal sealing surface. A positioning bar assembly is operatively positioned within the longitudinal guidance slot. A biasing element is supported at a first end by the pump assembly housing and supported at a second end by the positioning bar assembly. A connecting rod assembly is securely connected at a first end to the positioning bar, the connecting rod being positioned within the fluid passageway. The connecting rod assembly terminates with a flow inhibiting element. A seal element is positioned between the pump assembly housing and the internal check valve assembly to provide a closure for the pressurization cavity. At least one external check valve is in fluid communication with the pump assembly housing outlet for maintaining the fluid pressure provided by the at least one pump assembly.

At an initial fill position, the actuator positions the shaft at an upper position in which the positioning bar assembly is biased by the biasing element against a stop portion of the pump assembly housing. A flow passage is formed allowing cryogenic fluid to flow from the container assembly, through the longitudinal positioning opening of the pump assembly housing, through the longitudinal guidance slot of the shaft, through the fluid passageway of the shaft, through a space formed between the flow inhibiting element and the internal sealing surface, and into the pressurization cavity.

At intermediate fill positions the shaft moves in a first direction longitudinally through the pressurization cavity toward the flow inhibiting element. At a shutoff position, the internal sealing surface of the shaft contacts the flow inhibiting element creating a seal therebetween. In a pressurization cycle, the shaft moves longitudinally further through the pressurization cavity compressing the fluid within the pressurization cavity and displacing the fluid through the fluid generator outlet. At the beginning of an upstroke, the internal check valve assembly moves in a second, reverse direction in the pressurization cavity until the positioning bar assembly contacts the stop portion of the pump assembly housing. At intermediate parts of the upstroke, the shaft continues to move in the second direction while other portions of the internal check valve assembly remain stationary, thus creating an expanding gap between the flow inhibiting element and the internal sealing surface and allowing fluid to flow into the pressurization cavity. At the end of an upstroke, the shaft moves to the initial fill position. Thus, filling is provided without loss of sealing engagement of the shaft and the seal element.

The present invention is very reliable, efficient, and compact relative to prior art pump designs. For example, a centrifugal pump requires multiple stages to pressurize at relatively high pressures. The present invention, on the other hand, provides single stage operation. Aside from the actuator itself, the only moving part is the internal check valve assembly. This provides space and efficiency advantages. Minimization of the moving parts provides less energy loss due to frictional heating. Bellows pumps generally have lower life cycles and operating pressures; and, are more costly.

The present invention provides operation in a pressure regime greater than 250 psi under cryogenic temperature conditions. The flanged seal element is preferably formed of plastic. Use of plastic is advantageous because it takes up the tolerance variations inherent in all mechanical components; it minimizes leakage; and, enhances reliability relative to metal to metal sealing arrangements or seal less designs. Heretofore, it was not believed that a plastic seal could be utilized because of the extreme temperatures and cyclic loading during operation. However, use of TEFLON® plastic has been found to be an acceptable material for this sealing element.

DETAILED DESCRIPTION OF THE INVENTION

Figure 1:
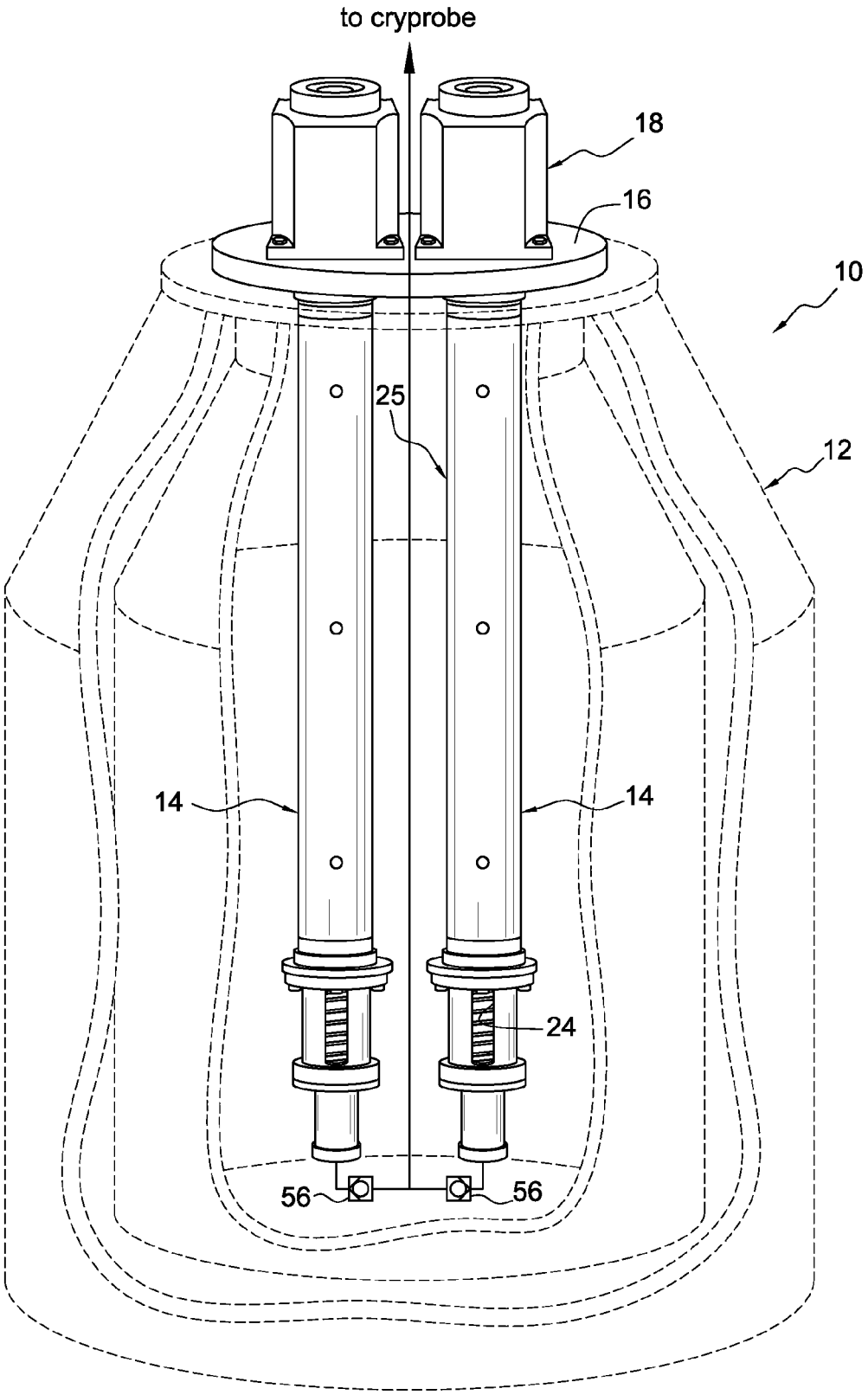
FIG. 1 is a cutaway perspective illustration of the high pressure cryogenic fluid generator of the present invention, showing the interior of the fluid generator, with a phantom line showing of the exterior thereof.

Referring now to the drawings and the characters of reference marked thereon, FIG. 1 illustrates a preferred embodiment of the high pressure cryogenic fluid generator of the present invention, designated generally as 10. The generator 10 includes a container assembly (i.e. dewar assembly 12) for containing a cryogenic liquid; and, a pair of pump assemblies 14. The dewar assembly 12 has a fixed structural top plate 16. Each pump assembly 14 includes a linear actuator 18 mounted to the dewar assembly 12 having a portion thereof extending externally from the dewar assembly 12 and another portion extending internally within the dewar assembly 12. Instead of a dewar assembly 12, other types of suitable insulated container assemblies may be used as known in this field. The linear actuator used may be, for example, a d.c. stepper motor. However, other types of linear actuators or other actuators may be used. Alternative actuators include, for example, pneumatic and hydraulic actuators. Alternate linear type actuators may be, for example, servo control motor types.

A structural support assembly 20 of each pump assembly 14 is securely attached at a first end thereof to the dewar assembly 12. The structural support assembly 20 has a central housing opening (i.e. support assembly opening).

Figure 2:
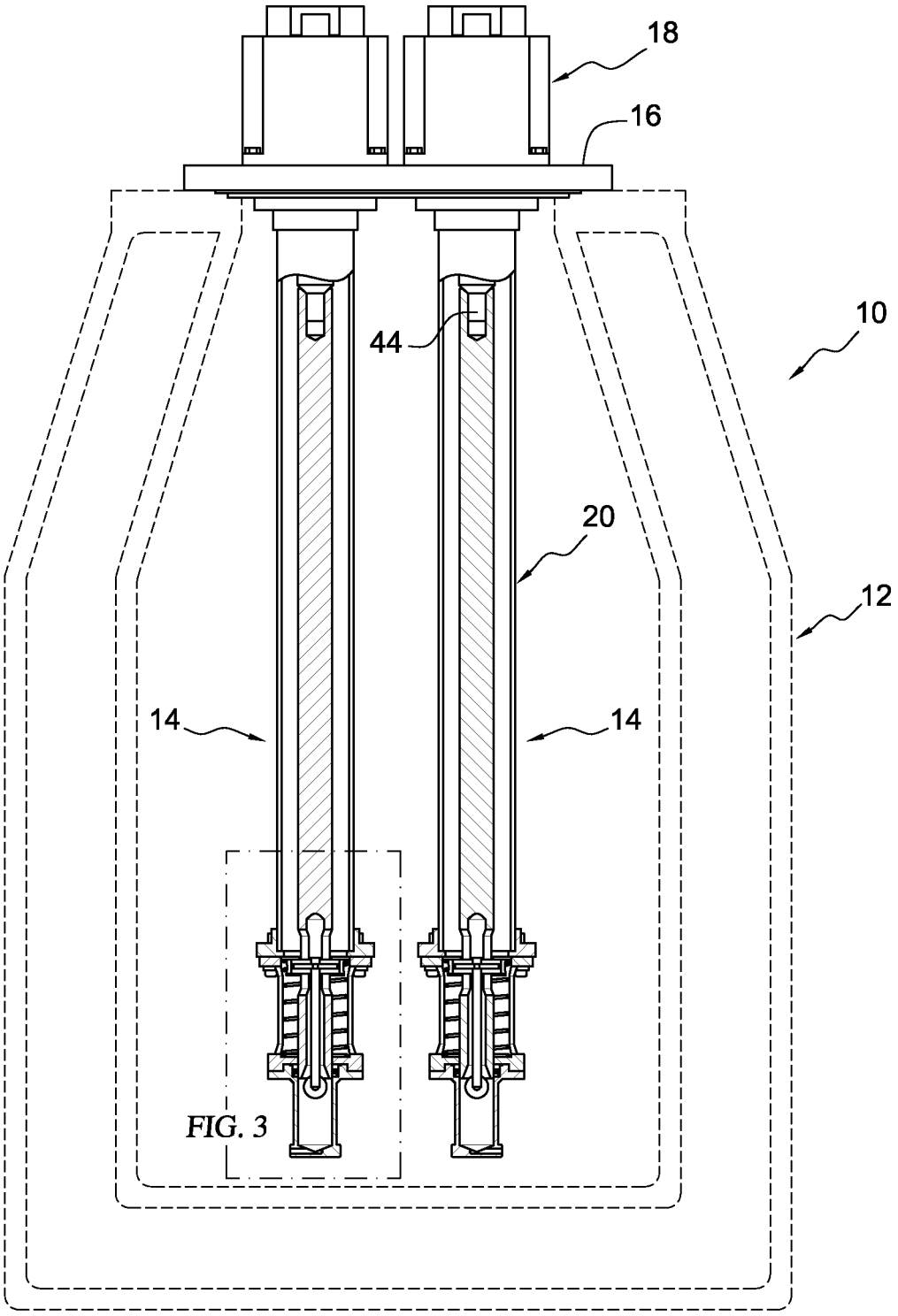
FIG. 2 is an overall cross section taken from FIG. 1.
Figure 3:
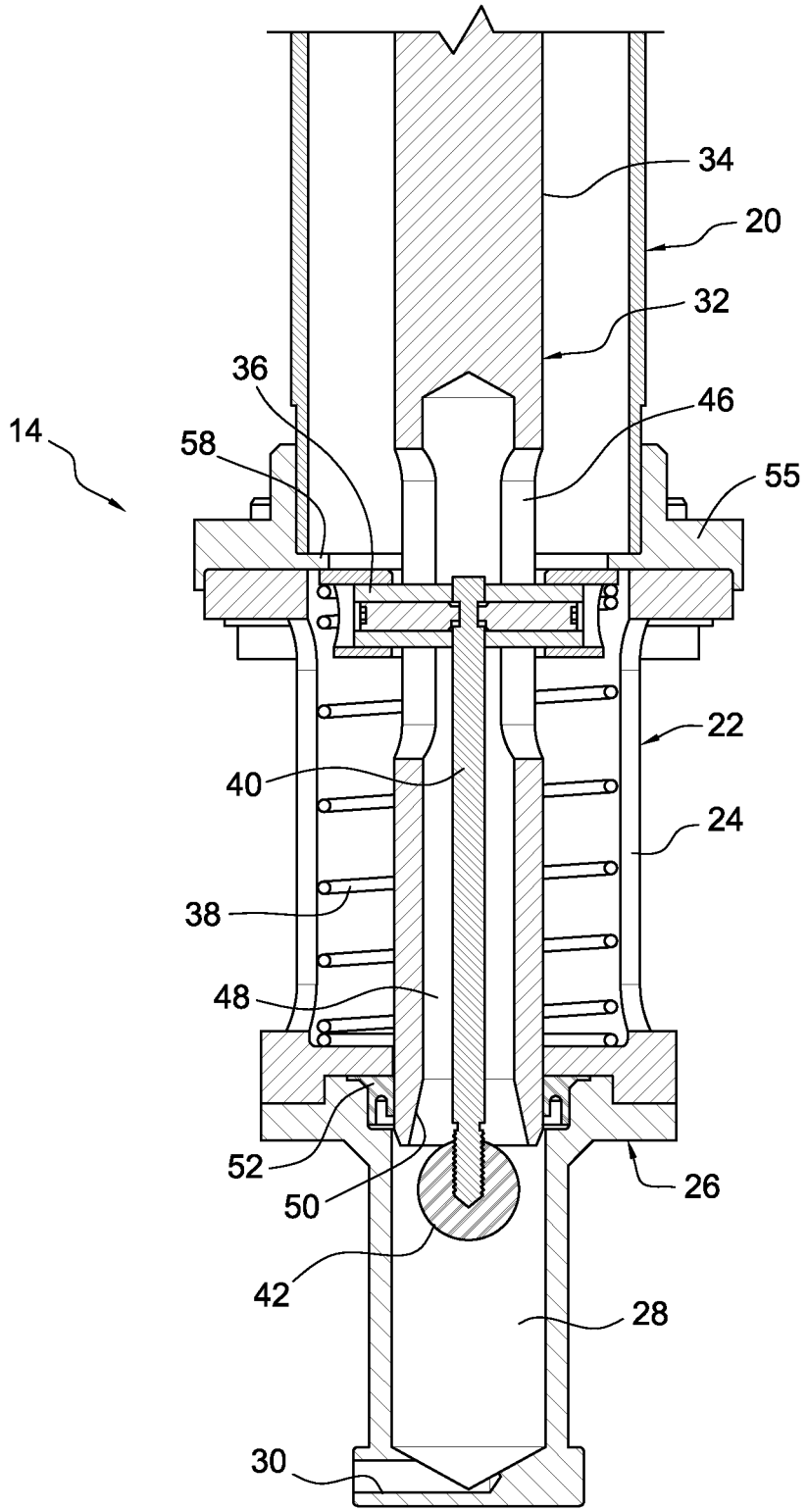
FIG. 3 is a section showing initial fill.

Referring now to FIGS. 2 and 3, a positioning bar housing 22 is attached to a second end of the structural support assembly 20. The positioning bar housing 22 includes at least one longitudinal positioning slot 24.

An internal check valve assembly housing 26 is securely attached to the positioning bar housing 22. The internal check valve assembly housing 26 has a pressurization cavity 28 formed therein and an internal check valve assembly outlet 30. The structural support assembly 20, positioning bar housing 22 and internal check valve assembly housing 26 are collectively referred to as a pump assembly housing.

An internal check valve assembly 32 is operatively associated with the internal check valve assembly housing 26. The internal check valve assembly 32 includes a shaft 34, a positioning bar assembly 36, a biasing element, (i.e. spring 38), a connecting rod 40, and a flow inhibiting element (i.e. flow inhibiting ball 42). The connecting rod 40 and flow inhibiting ball 42 are collectively referred to as a connecting rod assembly. Although a flow inhibiting ball 42 has been shown other types of flow inhibiting elements may alternatively be utilized such as a disc shaped element with a curved contact surface.

The shaft 34 is positioned within the central support assembly opening of the structural support assembly 20 and having a distal end thereof. Furthermore, the shaft 34 is positioned within the positioning bar housing 22, and concentrically positioned within the pressurization cavity 28. It is fixedly attached at a first end to the linear actuator 18, via a stub 44. The shaft 34 includes a longitudinal guidance slot 46. The shaft 34 has a fluid passageway 48 formed therein that extends from the longitudinal guidance slot 46 to the distal end. The distal end of the shaft 34 has an internal sealing surface (i.e. conical surface 50).

The positioning bar assembly 36 is operatively positioned within the longitudinal guidance slot 46. The spring 38 is supported at a first end by the positioning bar housing 22 and supported at a second end by the positioning bar assembly 36. The connecting rod 40 is securely connected at a first end to the positioning bar assembly 36. The connecting rod is positioned within the fluid passageway. The flow inhibiting ball 42 is securely connected to a second end of the connecting rod 40.

A plastic flanged seal element 52 is positioned longitudinally between the positioning bar housing 22 and the internal check valve assembly housing 26. The seal element 52, the internal check valve assembly 32, and the positioning bar housing 22 cooperate to provide a closure for the pressurization cavity 28. The seal element is preferably a TEFLON® plastic having an elongation property in the range of about 200% to 600% and a tensile strength within a range of about 2,000 PSI to 6,000 PSI.

An associated external check valve 56 is in fluid communication with the outlet 30 of the pump assembly housing for maintaining the fluid pressure provided by that pump assembly 14.

In the initial fill position illustrated in FIG. 3, the linear actuator 18 positions the shaft 34 at an upper position in which the positioning bar assembly 36 is biased by the spring 38 against a stop portion 54 of the lower portion 58 of the structural support assembly 20. A flow passage is formed allowing cryogenic fluid to flow from the dewar assembly 12, through the longitudinal positioning slot 24 of the positioning bar housing 22, through the longitudinal guidance slot 46 of the shaft 34, through the fluid passageway 48 of the shaft, through a space formed between said flow inhibiting ball 42 and the conical surface 50, and into the pressurization cavity 28 of the internal check valve assembly housing 26.

Figure 4:
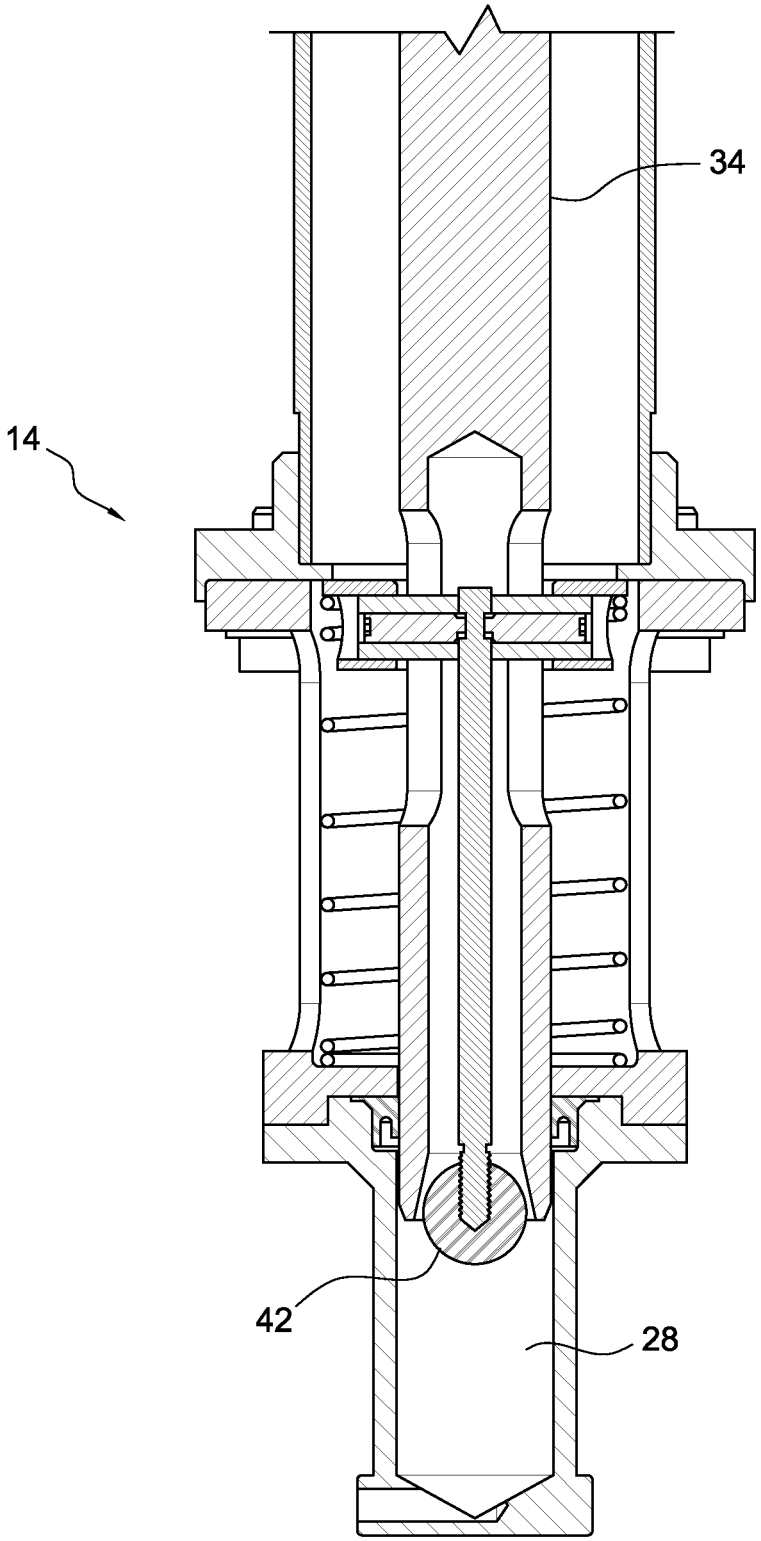
FIG. 4 is a section showing intermediate fill.

In an intermediate fill position illustrated in FIG. 4, the shaft 34 moves in a first direction longitudinally through the pressurization cavity 28 toward the flow inhibiting ball.

Figure 5:
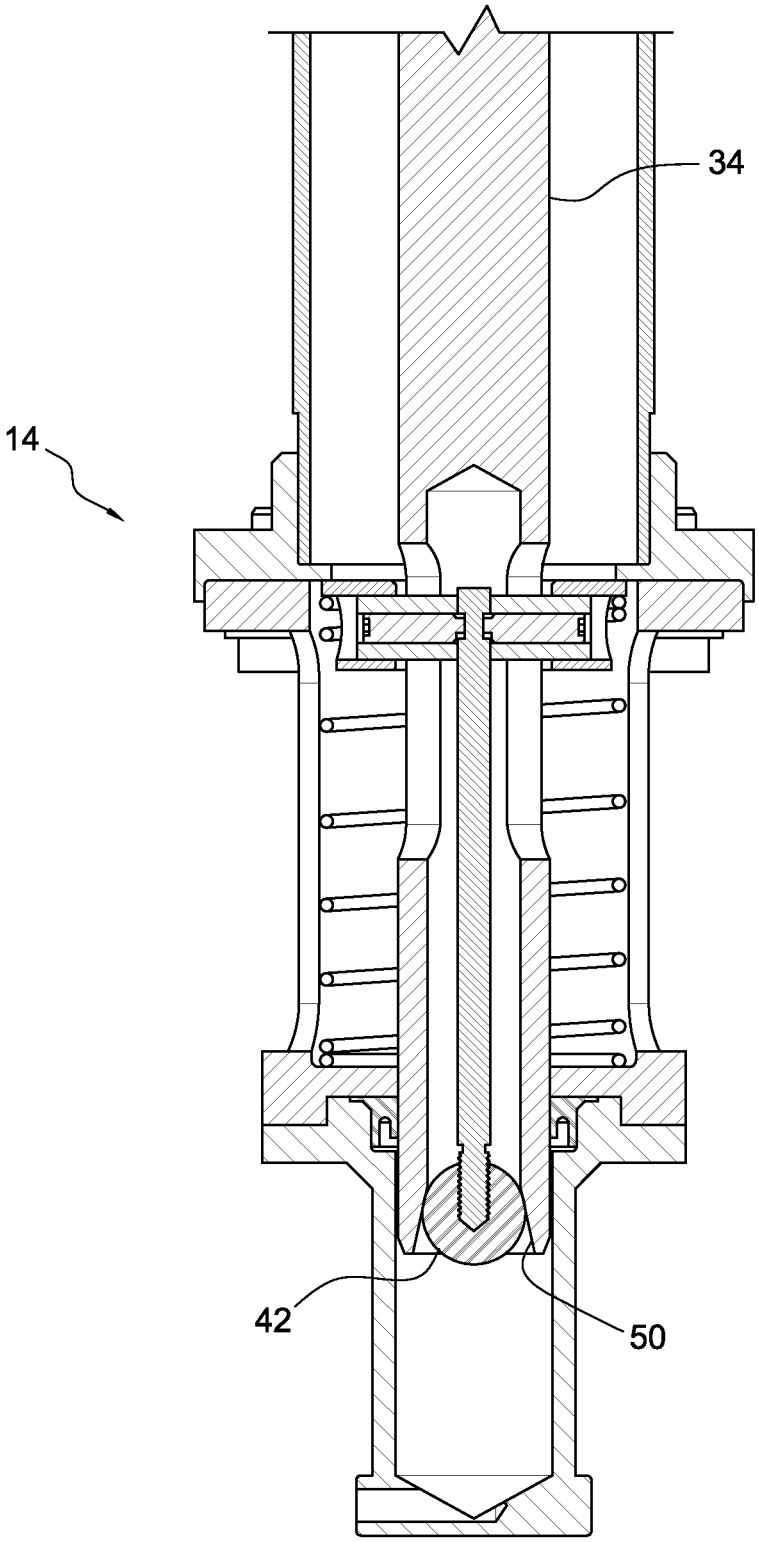
FIG. 5 is a section showing shutoff position.

At a shutoff position illustrated in FIG. 5, the conical surface 50 of the shaft 34 contacts the flow inhibiting ball 42 creating a seal therebetween.

Figure 6:
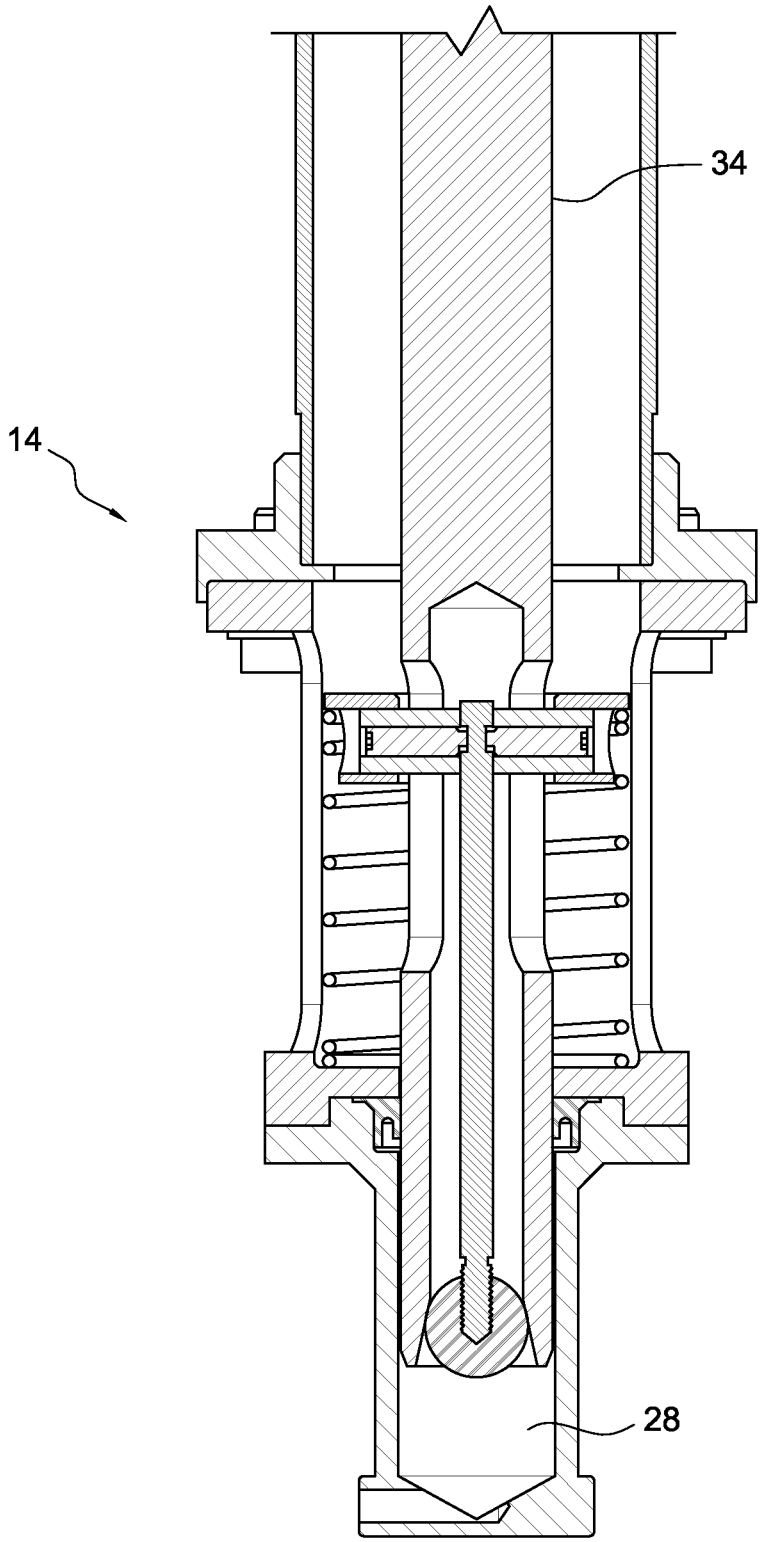
FIG. 6 is a section showing the pressurization cycle position.

Referring now to FIG. 6, in a pressurization cycle, the shaft 34 moves longitudinally further through the pressurization cavity 28 compressing the fluid within the pressurization cavity 28 and displacing the fluid through the fluid generator outlet. The external check valves 56 provide subsequent distribution to the cryoprobe (not shown).

Figure 7:
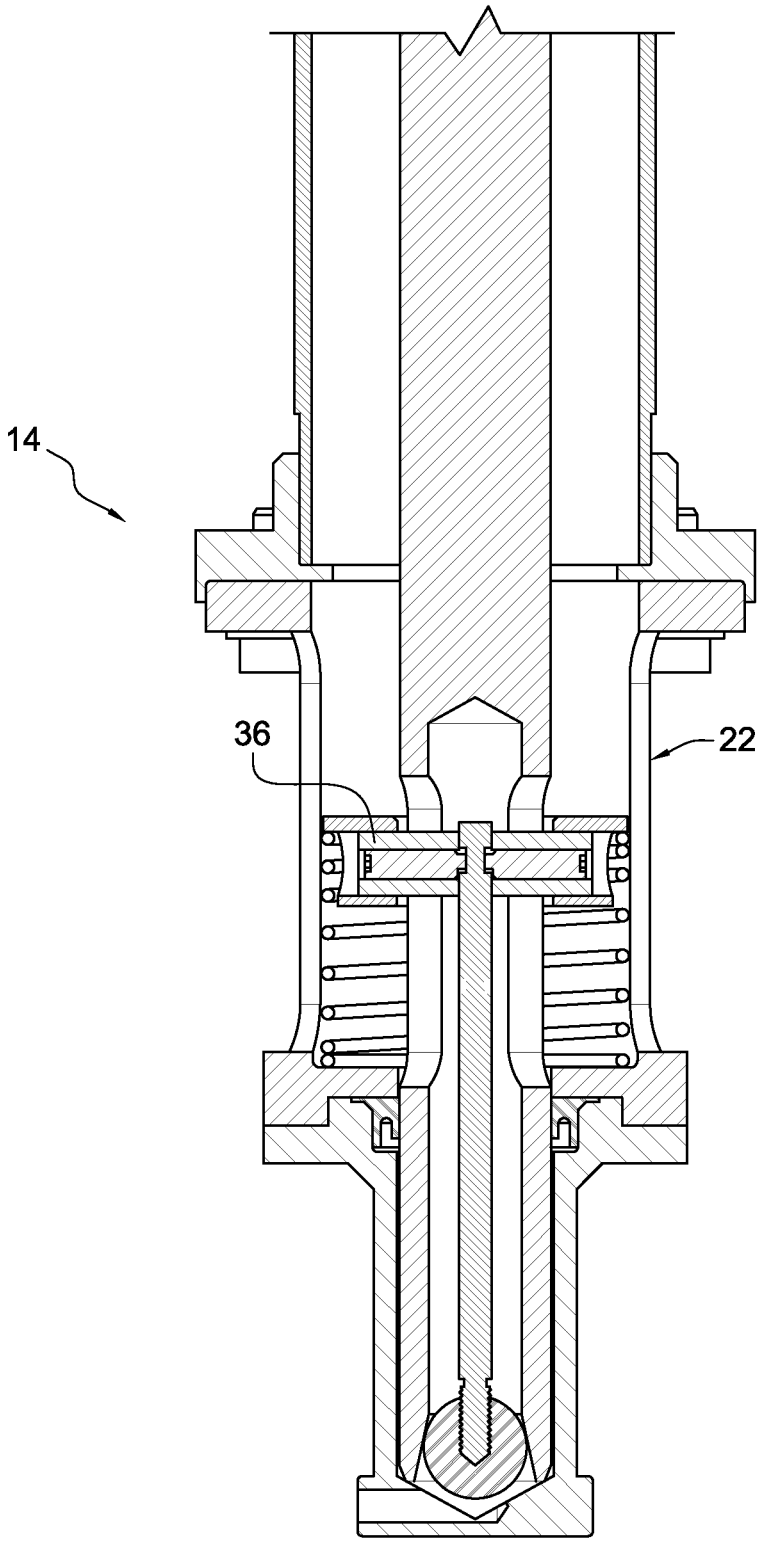
FIG. 7 is a section showing the beginning of upstroke.

As illustrated in FIG. 7, at the beginning of an upstroke, the internal check valve assembly 32 moves in a second, reverse direction in the pressurization cavity 28 until the positioning bar assembly 36 contacts the stop portion 54 of the positioning bar housing 22.

Figure 8:
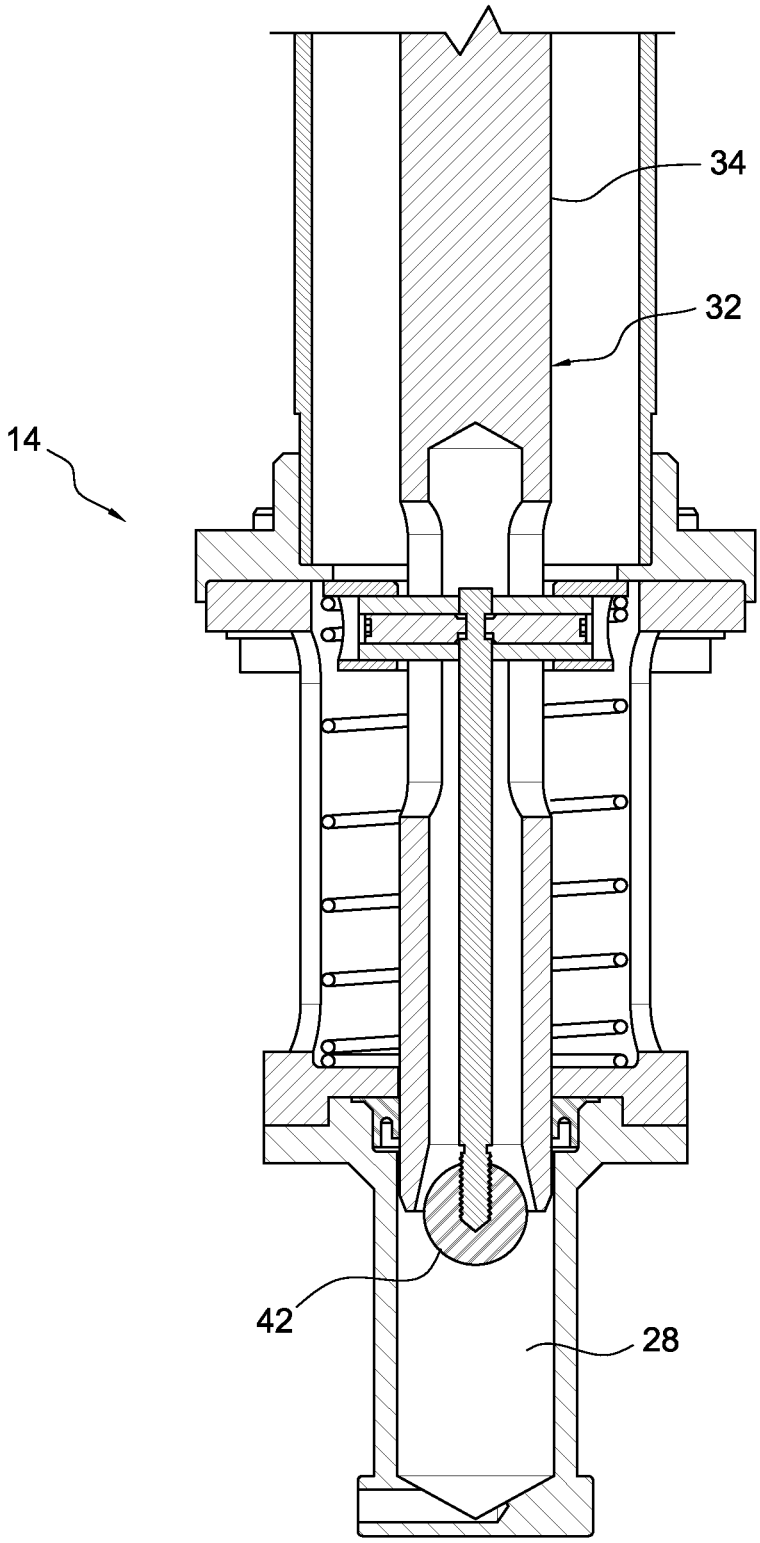
FIG. 8 is a section showing the intermediate part of upstroke.

As illustrated in FIG. 8, at intermediate parts of the upstroke, the shaft 34 continues to move in the second direction while other portions of the internal check valve assembly 32 remain stationary, thus creating an expanding gap between the flow inhibiting ball 42 and the conical surface 50 and allowing fluid to flow into the pressurization cavity 28.

Figure 9:
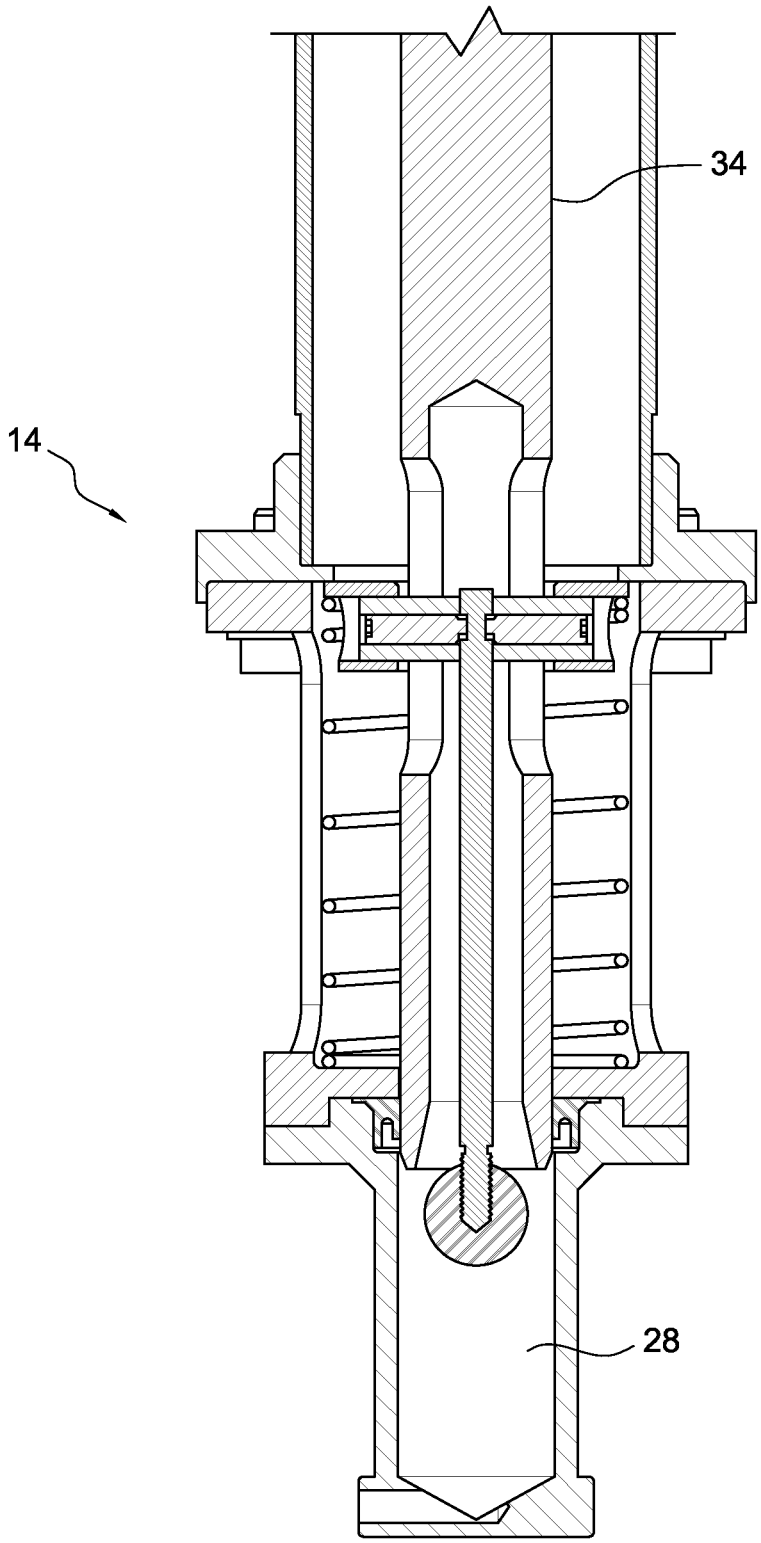
FIG. 9 is a section showing the end of upstroke.

Referring to FIG. 9, at the end of an upstroke, the shaft 34 moves to the initial fill position. Thus, filling is provided without loss of sealing engagement of the shaft 34 and the seal element 52.

The fluid generator preferably operates at an inlet pressure of 0 to 45 psig and compressed to a pressure range of 50 psig to 750 psig at the generator outlet. The present invention is likely to utilize liquid nitrogen; however other cryogens such as, helium and argon could also be used. This may provide fluid at the outlet of the fluid generator in a liquid state.

The cryogenic fluid utilized may be near critical. It is preferably near critical; however, other near critical cryogenic fluids may be utilized such as argon, neon, or helium. As used herein, the term "near critical" refers to the liquid-vapor critical point. Use of this term is equivalent to the phrase "near a critical point" and it is the region where the liquid-vapor system is adequately close to the critical point, where the dynamic viscosity of the fluid is close to that of a normal gas and much less than that of the liquid; yet, at the same time its density is close to that of a normal liquid state. The thermal capacity of the near critical fluid is even greater than that of its liquid phase. The combination of gas-like viscosity, liquid-like density and very large thermal capacity makes it a very efficient coolant agent. In other words, reference to a near critical point refers to the region where the liquid-vapor system is adequately close to the critical point so that fluctuations of the liquid and vapor phase are large enough to create a large enhancement of the heat capacity over its background value. As used herein, the term near critical temperature refers to a temperature within ±10% of the critical point temperature. The near critical pressure is between 0.8 and 1.2 times the critical pressure.

In an example, a NEMA 34 stepper motor manufactured by ElectroCraft, Inc., Dover, N.H., marketed as "TP34: TorquePower™ Stepper Motor" was used as the driving linear actuator. The linear actuator is rated above 800 pounds of force at stall condition and above 350 pounds of force at a linear velocity of 1 inch per second. The electrical supply requirement for this motor is 48 VDC and 10 amps per phase. The piston shaft connecting to the motor is made from 17-4 ph stainless steel. The shaft is hardened by heat treating to an H900 condition. The hardened surface reached a 44 Rockwell Hardness to help lengthen the life of the shaft. The positioning bar assembly and the connecting rod are made from 300 series stainless steel. A 260 brass alloy material was used for the flow inhibiting ball. The ball material is intended to be of a softer material than the shaft. This allows the ball to deform during contact with the hardened piston shaft filling ups small voids at the contact point and creating a more uniform sealing surface between the ball and the shaft. The circumferential contacting force between the ball and the shaft is critical to maintain a good seal. The minimum circumferential force is determined to be 7 pounds per inch for the material conditions of the present example. (Although, the circumferential force within the range of 9 pounds per inch to 15 pounds per inch were designed for the present example.) The circumferential force is generated from the spring element installed within the positioning bar housing.

The spring element is ground flat on both ends to optimize the force vector and minimize the rotational movement of the inhibiting ball. The plastic seal is a critical component of the present invention. A flange configuration is chosen over a non-flange configuration because it provides a secondary seal against the thermal contraction effect of cryogenic temperature. TEFLON® material is chosen due to the cryogenic temperatures. A modified version of the virgin TEFLON® material is selected for the combination high tensile strength (5300 psig) and high elongation properties (500%) and a low friction coefficient (0.09). The structural support assembly is made of stainless steel material so as to maintain uniform thermal of contraction/expansion with that of the stainless steel shaft.

Comparison tests on the freezing power of liquid nitrogen and high pressure argon gas were performed. Two different test media (water and gelatin) were used and at different initial temperature settings. The first two tests were performed with water at 20° C. and at 36° C. The third test was performed with gelatin at 20° C. Liquid nitrogen from the high pressure fluid generator of the present invention and conventional Joule Thomson technology-based argon cryoprobes were allowed to freeze for 10 minutes duration. At the end of the test the outer diameter of ice formed around each cryoprobe was measured. In 20° C. water, the ice ball diameter formed by the nitrogen cryoprobe was 3.16 cm versus 2.52 cm by the argon cryoprobe. At 36° C. the ice ball diameter formed by the nitrogen cryoprobe was 2.10 cm versus 1.28 cm by the argon cryoprobe. In 20° C. gelatin, the ice ball diameter formed by the nitrogen cryoprobe was 4.20 cm versus 3.75 cm by the argon cryoprobe. From these results, it can be seen that liquid nitrogen is a powerful cryogen that can be beneficial in providing cryoablation to treat areas of the body with high heat load such as the beating heart, etc.

Other embodiments and configurations may be devised without departing from the spirit of the invention and the scope of the appended claims.

The invention claimed is:

1. A high pressure cryogenic fluid generator, comprising:

a) a container assembly for containing a cryogenic fluid;

b) at least one pump assembly, comprising:

i. an actuator mounted to said container assembly;

ii. a pump assembly housing having a housing opening and being securely attached at a first end thereof to said container assembly, said pump assembly housing including at least one longitudinal positioning opening, said pump assembly housing having a pressurization cavity formed therein at a distal end terminating with a pump assembly outlet;

iii. an internal check valve assembly operatively associated with said pump assembly housing, said internal check valve assembly, comprising:

1. a shaft positioned within said housing opening of said pump assembly housing and having a distal end thereof, said shaft extending into said pressurization cavity, said shaft being fixedly attached at a first end to said actuator, said shaft including a longitudinal guidance slot, said shaft having a fluid passageway formed therein that extends from said longitudinal guidance slot to said distal end, said distal end of said shaft having an internal sealing surface;
2. a positioning bar assembly operatively positioned within said longitudinal guidance slot;
3. a biasing element supported at a first end by said pump assembly housing and supported at a second end by said positioning bar assembly; and,
4. a connecting rod assembly securely connected at a first end to said positioning bar, said connecting rod being positioned within said fluid passageway, said connecting rod assembly terminating with a flow inhibiting element; and, iv. a seal element positioned between said pump assembly housing and said internal check valve assembly to provide a closure for said pressurization cavity; and, c) at least one external check valve in fluid communication with said pump assembly housing outlet for maintaining the fluid pressure provided by said at least one pump assembly, wherein, i) at an initial fill position, said actuator positions said shaft at an upper position in which said positioning bar assembly is biased by said biasing element against a stop portion of said pump assembly housing, and a flow passage is formed allowing cryogenic fluid to flow from said container assembly, through said longitudinal positioning opening of said pump assembly housing, through said longitudinal guidance slot of said shaft, through said fluid passageway of said shaft, through a space formed between said flow inhibiting element and said internal sealing surface, and into said pressurization cavity;

ii) at intermediate fill positions said shaft moves in a first direction longitudinally through said pressurization cavity toward said flow inhibiting element;

iii) at a shutoff position, said internal sealing surface of said shaft contacts said flow inhibiting element creating a seal therebetween;

iv) in a pressurization cycle, said shaft moves longitudinally further through said pressurization cavity compressing the fluid within said pressurization cavity and displacing said fluid through said fluid generator outlet;

v) at the beginning of an upstroke, said internal check valve assembly moves in a second, reverse direction in said pressurization cavity until said positioning bar assembly contacts said stop portion of said pump assembly housing;

vi) at intermediate parts of the upstroke, said shaft continues to move in said second direction while other portions of said internal check valve assembly remain stationary, thus creating an expanding gap between said flow inhibiting element and said internal sealing surface and allowing fluid to flow into said pressurization cavity; and, vii) at the end of an upstroke, said shaft moves to said initial fill position, wherein filling is provided without loss of sealing engagement of said shaft and said seal element.

2. The high pressure cryogenic fluid generator of claim 1, wherein said at least one pump assembly comprises a pair of pump assemblies.

3. The high pressure cryogenic fluid generator of claim 1, wherein said cryogenic fluid comprises liquid nitrogen.

4. The high pressure cryogenic fluid generator of claim 1, wherein said cryogenic fluid comprises near critical nitrogen.

5. The high pressure cryogenic fluid generator of claim 1, wherein said container assembly comprises a dewar assembly.

6. The high pressure cryogenic fluid generator of claim 1, wherein said actuator comprises a linear actuator.

7. The high pressure cryogenic fluid generator of claim 1, wherein said pump assembly, comprises:

a) a structural support assembly having an opening, said structural support assembly being securely attached at a first end thereof to said container assembly;

b) a positioning bar housing attached to a second end of said structural support assembly, said positioning bar housing including said at least one longitudinal positioning opening; and, c) an internal check valve assembly housing securely attached to said positioning bar housing, said internal check valve assembly housing having said pressurization cavity formed therein and said fluid generator outlet.

8. The high pressure cryogenic fluid generator of claim 1, wherein said internal sealing surface comprises an internal conical surface.

9. The high pressure cryogenic fluid generator of claim 1, wherein said connecting rod assembly comprises:

a) a connecting rod securely connected at a first end to said positioning bar; and, b) a flow inhibiting ball securely connected to a second end of said connecting rod.

10. The high pressure cryogenic fluid generator of claim 1, wherein said seal element comprises a flanged plastic seal element.

11. A high pressure cryogenic fluid generator, comprising:

a) a container assembly for containing a cryogenic liquid; and, b) at least one pump assembly, comprising:

i. an actuator mounted to said container assembly;

ii. a structural support assembly having a support assembly opening, said structural support assembly being securely attached at a first end thereof to said container assembly;

iii. a positioning bar housing attached to a second end of said structural support assembly, said positioning bar housing including at least one longitudinal positioning opening;

iv. an internal check valve assembly housing securely attached to said positioning bar housing, said internal check valve assembly housing having a pressurization cavity formed therein and a fluid generator outlet;

v. an internal check valve assembly operatively associated with said internal check valve assembly housing, said internal check valve assembly, comprising:

1. a shaft positioned within said support assembly opening of said structural support assembly and having a distal end thereof, said shaft being positioned within said positioning bar housing, and concentrically positioned within said pressurization cavity, said shaft being fixedly attached at a first end to said actuator, said shaft including a longitudinal guidance slot, said shaft having a fluid passageway formed therein that extends from said longitudinal guidance slot to said distal end, said distal end of said shaft having an internal conical surface;

2. a positioning bar assembly operatively positioned within said longitudinal guidance slot;
3. a biasing element supported at a first end by said positioning bar housing and supported at a second end by said positioning bar assembly;
4. a connecting rod securely connected at a first end to said positioning bar, said connecting rod assembly being positioned within said fluid passageway; and,
5. a flow inhibiting ball securely connected to a second end of said connecting rod; and, vi. a seal element positioned longitudinally between said positioning bar housing and said internal check valve assembly housing, wherein said seal element, said internal check valve assembly, and said positioning bar housing cooperate to provide a closure for said pressurization cavity, wherein, i) at an initial fill position, said linear actuator positions said shaft at an upper position in which said positioning bar assembly is biased by said spring against a stop portion of said structural support assembly, and a flow passage is formed allowing cryogenic fluid to flow from said dewar assembly, through said longitudinal positioning slot of said positioning bar housing, through said longitudinal guidance slot of said shaft, through said fluid passageway of said shaft, through a space formed between said flow inhibiting ball and said conical surface, and into said pressurization cavity of said internal check valve assembly housing;

ii) at intermediate fill positions said shaft moves in a first direction longitudinally through said pressurization cavity toward said flow inhibiting ball;

iii) at a shutoff position, said conical surface of said shaft contacts said flow inhibiting ball creating a seal therebetween;

iv) in a pressurization cycle, said shaft moves longitudinally further through said pressurization cavity compressing the fluid within said pressurization cavity and displacing said fluid through said fluid generator outlet;

v) at the beginning of an upstroke, said internal check valve assembly moves in a second, reverse direction in said pressurization cavity until said positioning bar assembly contacts said stop portion of said positioning bar housing;

vi) at intermediate parts of the upstroke, said shaft continues to move in said second direction while other portions of said internal check valve assembly remain stationary, thus creating an expanding gap between said flow inhibiting ball and said conical surface and allowing fluid to flow into said pressurization cavity; and, vii) at the end of an upstroke, said shaft moves to said initial fill position, wherein filling is provided without loss of sealing engagement of said shaft and said seal element.

12. The high pressure cryogenic fluid generator of claim 11, wherein said at least one pump assembly comprises a pair of pump assemblies.

13. The high pressure cryogenic fluid generator of claim 12, wherein said flanged seal element comprises a plastic seal element.

14. The high pressure cryogenic fluid generator of claim 12, wherein said cryogenic liquid comprises liquid nitrogen.

15. A high pressure cryogenic fluid generator, comprising:

a) a dewar assembly for containing a cryogenic liquid; and, b) at least one pump assembly, comprising:

i. a linear actuator mounted to said dewar assembly having a portion thereof extending externally from said dewar assembly and another portion extending internally within said dewar assembly;

ii. a structural support assembly having a support assembly opening, said structural support assembly being securely attached at a first end thereof to said dewar assembly;

iii. a positioning bar housing attached to a second end of said structural support assembly, said positioning bar housing including at least one longitudinal positioning opening;

iv. an internal check valve assembly housing securely attached to said positioning bar housing, said internal check valve assembly housing having a pressurization cavity formed therein and a fluid generator outlet;

v. an internal check valve assembly operatively associated with said internal check valve assembly housing, said internal check valve assembly, comprising:

1. a shaft positioned within said support assembly opening of said structural support assembly and having a distal end thereof, said shaft being positioned within said positioning bar housing, and concentrically positioned within said pressurization cavity, said shaft being fixedly attached at a first end to said linear actuator, said shaft including a longitudinal guidance slot, said shaft having a fluid passageway formed therein that extends from said longitudinal guidance slot to said distal end, said distal end of said shaft having an internal conical surface;
2. a positioning bar assembly operatively positioned within said longitudinal guidance slot;
3. a spring supported at a first end by said positioning bar housing and supported at a second end by said positioning bar assembly;
4. a connecting rod securely connected at a first end to said positioning bar; and,
5. a flow inhibiting ball securely connected to a second end of said connecting rod; and, vi. a flanged seal element positioned longitudinally between said positioning bar housing and said internal check valve assembly housing, wherein said seal element, said internal check valve assembly, and said positioning bar housing cooperate to provide a closure for said pressurization cavity, wherein, i) at an initial fill position, said linear actuator positions said shaft at an upper position in which said positioning bar assembly is biased by said spring against a stop portion of said structural support assembly, and a flow passage is formed allowing cryogenic fluid to flow from said dewar assembly, through said longitudinal positioning slot of said positioning bar housing, through said longitudinal guidance slot of said shaft, through said fluid passageway of said shaft, through a space formed between said flow inhibiting ball and said conical surface, and into said pressurization cavity of said internal check valve assembly housing;

ii) at intermediate fill positions said shaft moves in a first direction longitudinally through said pressurization cavity toward said flow inhibiting ball;

iii) at a shutoff position, said conical surface of said shaft contacts said flow inhibiting ball creating a seal therebetween;

iv) in a pressurization cycle, said shaft moves longitudinally further through said pressurization cavity compressing the fluid within said pressurization cavity and displacing said fluid through said fluid generator outlet;

v) at the beginning of an upstroke, said internal check valve assembly moves in a second, reverse direction in said pressurization cavity until said positioning bar assembly contacts said stop portion of said positioning bar housing;

vi) at intermediate parts of the upstroke, said shaft continues to move in said second direction while other portions of said internal check valve assembly remain stationary, thus creating an expanding gap between said flow inhibiting ball and said conical surface and allowing fluid to flow into said pressurization cavity;

vii) at the end of an upstroke, said shaft moves to said initial fill position, wherein filling is provided without loss of sealing engagement of said shaft and said seal element.

16. A pump assembly for a high pressure cryogenic fluid generator of a type including a container assembly for containing a cryogenic fluid and at least one external check valve in fluid communication with said pump assembly housing outlet for maintaining the fluid pressure provided by the at least one pump assembly, said pump assembly, comprising:

a) an actuator mounted to said container assembly;

b) a pump assembly housing having a housing opening and being securely attached at a first end thereof to said container assembly, said pump assembly housing including at least one longitudinal positioning opening, said pump assembly housing having a pressurization cavity formed therein at a distal end terminating with a pump assembly outlet;

c) an internal check valve assembly operatively associated with said pump assembly housing, said internal check valve assembly, comprising:

i. a shaft positioned within said housing opening of said pump assembly housing and having a distal end thereof, said shaft extending into said pressurization cavity, said shaft being fixedly attached at a first end to said actuator, said shaft including a longitudinal guidance slot, said shaft having a fluid passageway formed therein that extends from said longitudinal guidance slot to said distal end, said distal end of said shaft having an internal sealing surface;

ii. a positioning bar assembly operatively positioned within said longitudinal guidance slot;

iii. a biasing element supported at a first end by said pump assembly housing and supported at a second end by said positioning bar assembly; and, iv. a connecting rod assembly securely connected at a first end to said positioning bar, said connecting rod assembly being positioned within said fluid passageway, said connecting rod assembly terminating with a flow inhibiting element; and, and, d) a seal element positioned between said pump assembly housing and said internal check valve assembly to provide a closure for said pressurization cavity, wherein, i) at an initial fill position, said actuator positions said shaft at an upper position in which said positioning bar assembly is biased by said biasing element against a stop portion of said pump assembly housing, and a flow passage is formed allowing cryogenic fluid to flow from said container assembly, through said longitudinal positioning opening of said pump assembly housing, through said longitudinal guidance slot of said shaft, through said fluid passageway of said shaft, through a space formed between said flow inhibiting element and said internal sealing surface, and into said pressurization cavity;

ii) at intermediate fill positions said shaft moves in a first direction longitudinally through said pressurization cavity toward said flow inhibiting element;

iii) at a shutoff position, said internal sealing surface of said shaft contacts said flow inhibiting element creating a seal therebetween;

iv) in a pressurization cycle, said shaft moves longitudinally further through said pressurization cavity compressing the fluid within said pressurization cavity and displacing said fluid through said fluid generator outlet;

v) at the beginning of an upstroke, said internal check valve assembly moves in a second, reverse direction in said pressurization cavity until said positioning bar assembly contacts said stop portion of said pump assembly housing;

vi) at intermediate parts of the upstroke, said shaft continues to move in said second direction while other portions of said internal check valve assembly remain stationary, thus creating an expanding gap between said flow inhibiting element and said internal sealing surface and allowing fluid to flow into said pressurization cavity; and, vii) at the end of an upstroke, said shaft moves to said initial fill position, wherein filling is provided without loss of sealing engagement of said shaft and said seal element.

* * * * *